US006960068B1

(12) United States Patent
McNaull

(10) Patent No.: US 6,960,068 B1
(45) Date of Patent: Nov. 1, 2005

(54) CENTER VALVE SLEEVE RETENTION SYSTEM FOR AN OSCILLATING PUMP

(75) Inventor: Michael H. McNaull, Ashland, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 0 days.

(21) Appl. No.: 10/966,195

(22) Filed: Oct. 18, 2004

(51) Int. Cl.[7] ..... F04B 43/00; F04B 35/04; F04B 53/12; F04B 39/10; F04B 53/10

(52) U.S. Cl. ..... 417/423.1; 417/412; 417/416; 417/417; 417/472; 417/550; 417/567; 417/562; 417/555.1

(58) Field of Search ..... 417/412, 416, 417/417, 472, 550, 567, 562, 555.1; 137/512, 137/854; 92/46, 39, 44, 45

(56) References Cited

U.S. PATENT DOCUMENTS 3,136,257 A * 6/1964 Smith et al. ..... 417/241
4,824,337 A 4/1989 Lindner et al. ..... 417/417
5,147,281 A * 9/1992 Thornton et al. ..... 600/16
5,266,012 A * 11/1993 Hashimoto et al. ..... 417/412
5,915,930 A * 6/1999 McNaull ..... 417/417
6,012,910 A * 1/2000 McNaull ..... 417/412

* cited by examiner

*Primary Examiner*—Timothy S. Thorpe
*Assistant Examiner*—Christopher H. Orders
(74) *Attorney, Agent, or Firm*—Renner, Kenner, Greive, Bobak, Taylor & Weber

(57) ABSTRACT

A pump (10) includes an impeller (12) positioned in a housing (11). A valve assembly (13) is positioned within a valve sleeve (25) which is carried by the impeller (12). The impeller (12) is carried by an armature (27), and a pocket (28) is formed between the impeller (12) and the armature (27) adjacent to the valve sleeve (25). One or more elastomeric members (29) are positioned in the pocket (28) to surround the impeller (12) at the area of the valve sleeve (25) to provide a retaining force on the valve sleeve (25).

18 Claims, 1 Drawing Sheet

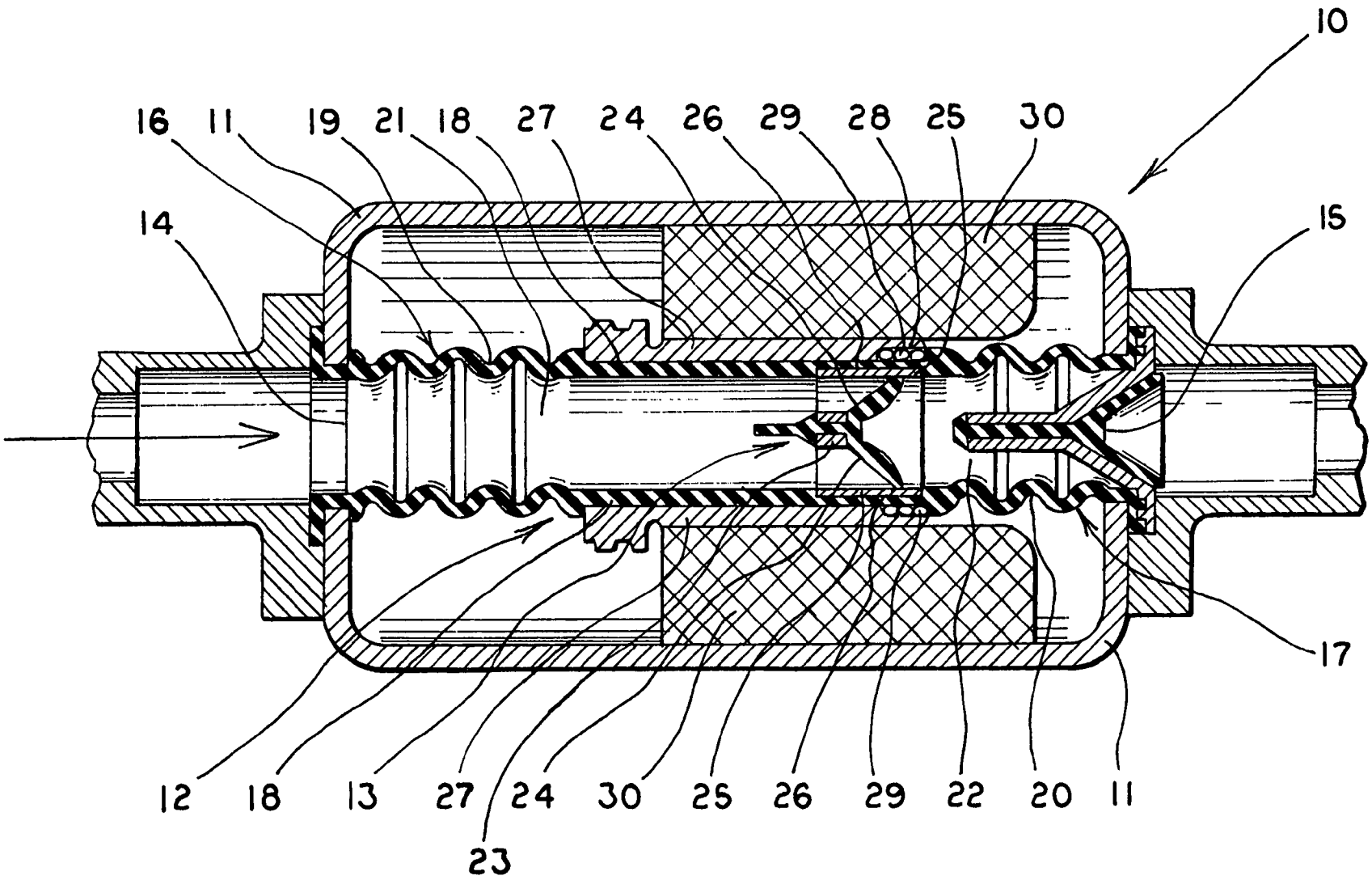
10
15
17
11
20
22
29
26
25
30
24
23
27
13
18
12
14
16
11
19
21
18
27
24
26
29
28
25
30

CENTER VALVE SLEEVE RETENTION SYSTEM FOR AN OSCILLATING PUMP

TECHNICAL FIELD

This invention relates to an improvement in an oscillating pump. More particularly, this invention relates to a system for retaining a valve sleeve in such a pump while at the same time minimizing potential damage to the impeller.

BACKGROUND ART

A conventional oscillating pump, such as shown in U.S. Pat. No. 5,915,930, includes a valve sleeve which carries a center valve. The sleeve fits within a recessed area formed in an elastomeric impeller. The impeller, which thus carries the sleeve and the valve, is then positioned in a metallic armature.

It has been found that after extended operation of such a pump, the pressure generated by the pump oftentimes causes the impeller to stretch thin, and eventually rupture, at the already thinned-out, recessed area which holds the sleeve.

Thus, the need exists for a system of positioning and retaining a center valve sleeve in an oscillating pump which will eliminate the fatigue on the impeller.

DISCLOSURE OF THE INVENTION

It is thus an object of the present invention to provide an oscillating pump with an improved system of retaining the valve sleeve in the impeller.

It is another object of the present invention to provide an oscillating pump, as above, which reduces the amount of wear on the impeller giving it a longer life.

These and other objects of the present invention, as well as the advantages thereof over existing prior art forms, which will become apparent from the description to follow, are accomplished by the improvements hereinafter described and claimed.

In general, a pump for moving fluid longitudinally from an inlet area to a discharge area includes a longitudinally extending impeller through which the fluid may pass from the inlet area to the outlet area. A valve sleeve is carried at a longitudinal position along the impeller, and a valve is positioned within the valve sleeve. At least one elastomeric member is positioned so as to exert a force against at least a portion of the longitudinal position of the valve sleeve along the impeller.

A preferred exemplary oscillating pump according to the concepts of the present invention is shown by way of example in the accompanying drawing without attempting to show all the various forms and modifications in which the invention might be embodied, the invention being measured by the appended claims and not by the details of the specification.

BRIEF DESCRIPTION OF THE DRAWING

The FIGURE is a somewhat schematic longitudinal cross section of an oscillating pump according to the present invention.

PREFERRED EMBODIMENT FOR CARRYING OUT THE INVENTION

An oscillating pump according to the present invention is indicated generally in the accompanying drawing by the numeral 10. Pump 10 includes a housing 11 which may be fabricated from any of a variety of materials, but it has been found that casting housing 11 from a zinc material results in a sturdy device that is relatively easy and inexpensive to manufacture.

An impeller, generally indicated by the numeral 12, is positioned within housing 11 and is a substantially hollow, cylindrical member preferably made from a suitable elastomeric material. Impeller 12 carries a center valve assembly, generally indicated by the numeral 13, which is preferably of the type shown in U.S. Pat. No. 4,824,337, to which reference is made for a complete understanding of this invention. However, valve 13 could also be in the form of a conventional ball valve without departing from the spirit of this invention. Fluid is permitted to enter impeller 12 longitudinally through inlet 14 and exits through a discharge area which includes a discharge valve 15 carried by housing 11. Discharge valve 15 is preferably a conventional poppet valve. However, a leaf valve could also be employed for valve 15 as well.

Impeller 12 includes an inlet area, indicated generally by the numeral 16, and a discharge area, indicated by the numeral 17, interconnected by a central portion 18. Inlet area 16 includes a bellows 19, and discharge area 17 includes a similar bellows 20. Bellows 19 is thus adjacent to inlet 14, and bellows 20 is thus adjacent to discharge valve 15. An inlet chamber 21 is formed within impeller 12 on the inlet side of center valve 13, and a discharge chamber 22 is formed on the discharge side of center valve 13.

Center valve assembly 13 includes a conventional leaf valve 23 having leaves 24 which in a static condition rest against the inside of a cylindrical valve sleeve 25. Valve sleeve 25 is prefably made of a polypropylene material and is received within a recess 26 formed in the central portion 18 of impeller 12.

Central portion 18 of impeller 12 is carried by a metallic cylindrical armature 27. One longitudinal end of armature 27 is dished out so as to form a pocket 28 with impeller 12. Pocket 28 is thus adjacent to one end of valve sleeve 25, and one or more elastomeric members 29, shown to be in the form of O-rings, are positioned in the pocket 28 and surround the central portion 18 of impeller 12 at the area of recess 26 and sleeve 25.

Armature 27 is circumferentially surrounded by an electromagnetic coil 30. With a conduit attached to each end of pump 10, pump 10 is in condition to pump a fluid in the direction of the arrow in the FIGURE. Upon the energization or activation of coil 30, armature 27 moves in the forward longitudinal direction (to the right in the FIGURE). As a result of the change of the position of the armature 27, discharge bellows 20 is compressed and inlet bellows 19 is expanded. As discharge bellows 20 is compressed, the volume of discharge chamber 22 is decreased, and leaves 24 of center valve 13 force fluid in discharge chamber 22 through discharge valve 15 and into a conduit. Simultaneously, inlet bellows 19 expands, thereby increasing the volume of inlet chamber 21 with an attendant decrease in pressure. This decrease in pressure induces additional fluid to enter into inlet chamber 21 through inlet 14.

Electromagnetic coil 30 is then de-energized, and the elastic forces of compressed discharge bellows 20 and expanded inlet bellows 19 can provide a return force such that armature 27 moves to the left in the FIGURE. Alternatively, the return force may be provided by a spring which bears against armature 27. As inlet bellows 19 compresses and discharge bellows 20 expands, the pressure in inlet chamber 21 increases and the pressure in discharge chamber 22 decreases, thereby closing discharge valve 15 and forcing fluid from inlet chamber 21, past leaves 24 of center valve 13, and into discharge chamber 22, which fluid is thus available for discharge upon the next energization of coil 30.

All during this movement, the elastomeric members 29, shown in the form of O-rings, squeeze around the outside of the thinned-out area formed by recess 26 of the central portion 18 of impeller 12. This squeezing action transfers a retaining force against the outside of valve sleeve 25 which assists in maintaining sleeve 25 in recess 26, and thereby improves wear on the impeller 12.

While the precise dimensions of various of the components that contribute to the subject invention are not critical, some of the relative dimensions do find some importance. For example, it is preferable that the outside diameter of impeller central portion 18, at least at the area adjacent to pocket 28, is greater than the inside diameter of the elastomeric member 29. Thus, for example, if the outside diameter of impeller central portion 18 is approximately 0.560 inches, the inside diameter of the O-rings should be approximately 0.489 inches so that a sufficient squeezing force is maintained.

Another dimensional issue relates to the longitudinal length of pocket 28 versus the length of sleeve 25, that is, how much of the length of sleeve 25 should be squeezed by elastomeric member 29. While such squeezing could be presented along the entire length of sleeve 25, it has been found that the benefit afforded by elastomeric member 29 has diminishing returns. Moreover, increasing the size of pocket 28 to any significant extent could potentially weaken armature 27. Thus, it has been found that the length of pocket 28, that is, the length of armature central portion 18 exposed to the squeezing force, should preferably be approximately forty percent of the length of sleeve 25. For example, for a sleeve 25 of about 0.495 inches in length, the length of the pocket 28 would be about 0.195 inches.

It is also preferable to longitudinally compress the elastomeric member 29 in pocket 28. Thus, the longitudinal height of the elastomeric member 29 should be greater than the length of the pocket 28. As shown in the FIGURE, there are three O-rings which make up elastomeric member 29. For a pocket 28 having a length of about 0.195 inches, as discussed above, each O-ring should have a cross sectional dimension of about 0.070 so that the total longitudinal dimension of the three O-rings is 0.210, that is, greater than 0.195, the longitudinal extent of pocket 28.

In view of the foregoing, it should be evident that a pump constructed as described herein accomplishes the objections of the present invention and otherwise substantially improves the art.

What is claimed is:

1. A pump for moving fluid longitudinally from an inlet area to a discharge area comprising a longitudinally extending impeller through which the fluid may pass from the inlet area to the outlet area, a valve sleeve carried at a longitudinal position along said impeller, a valve positioned within said valve sleeve, and at least one elastomeric member positioned so as to exert a force against said impeller along at least a portion of said longitudinal position of said valve sleeve.

2. The pump of claim 1 wherein said elastomeric member exerts a force against approximately forty percent of said longitudinal position of said valve sleeve along said impeller.

3. The pump of claim 1 wherein said impeller is cylindrical and said elastomeric member has an unstretched inside diameter smaller than the outside diameter of said impeller.

4. The pump of claim 1 further comprising an armature carrying said impeller.

5. The pump of claim 4 further comprising an electromagnet coil to move said armature.

6. The pump of claim 4 further comprising a longitudinally extending pocket formed between said impeller and said armature, said elastomeric member being positioned in said pocket.

7. The pump of claim 6 wherein said pocket has a longitudinal dimension less than the uncompressed longitudinal dimension of said elastomeric member.

8. The pump of claim 7 wherein said elastomeric member exerts a force against approximately forty percent of said longitudinal position of said valve sleeve along said impeller.

9. The pump of claim 8 wherein said impeller is cylindrical and said elastomeric member has an unstretched inside diameter smaller than the outside diameter of said impeller.

10. The pump of claim 1 wherein said elastomeric member is an O-ring.

11. The pump of claim 1 wherein said impeller includes a first bellows adjacent to the inlet area, a second bellows adjacent to the discharge area, and a portion between said first bellows and said second bellows, said portion including said longitudinal position where said valve sleeve is carried.

12. The pump of claim 11 further comprising an armature carrying said impeller and a coil to move said armature.

13. The pump of claim 12 wherein said elastomeric member exerts a force against approximately forty percent of said longitudinal position of said valve sleeve along said impeller.

14. The pump of claim 12 wherein said impeller is cylindrical and said elastomeric member has an unstretched inside diameter smaller than the outside diameter of said impeller.

15. The pump of claim 12 further comprising a longitudinally extending pocket formed between said impeller and said armature, said elastomeric member being positioned in said pocket.

16. The pump of claim 15 wherein said pocket has a longitudinal dimension less than the uncompressed longitudinal dimension of said elastomeric member member.

17. The pump of claim 1 further comprising a recess in said impeller, said valve sleeve being positioned in said recess.

18. The pump of claim 17 wherein said elastomeric member is positioned adjacent to said recess.

* * * * *